US010236612B2

(12) United States Patent
Meier et al.

(10) Patent No.: US 10,236,612 B2
(45) Date of Patent: Mar. 19, 2019

(54) FLAT CONTACT SOCKET

(71) Applicant: TE Connectivity Germany GmbH, Bensheim (DE)

(72) Inventors: Rudiger Meier, Neckargemund (DE); Jochen Fertig, Bensheim (DE); Holger Stange, Frankenthal (DE); Joachim Toboldt, Furth (DE); Niranjan Thirunavukkarasu, Neu-Isenburg (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/795,388

(22) Filed: Oct. 27, 2017

(65) Prior Publication Data

US 2018/0123275 A1 May 3, 2018

(30) Foreign Application Priority Data

Oct. 28, 2016 (DE) ..... 102016221351
Jan. 13, 2017 (EP) ..... 17151499

(51) Int. Cl.

| | |
|---|---|
| ***H01R 4/02*** | (2006.01) |
| ***H01R 4/48*** | (2006.01) |
| ***H01R 11/11*** | (2006.01) |
| ***H01R 12/70*** | (2011.01) |
| ***H01R 13/11*** | (2006.01) |

(Continued)

(52) U.S. Cl.

CPC ..... *H01R 13/113* (2013.01); *H01R 11/11* (2013.01); *H01R 12/7088* (2013.01);

(Continued)

(58) Field of Classification Search

CPC .... H01R 13/113; H01R 13/115; H01R 13/18; H01R 13/187; H01R 13/2442; H01R 43/16

See application file for complete search history.

(56) References Cited

U.S. PATENT DOCUMENTS 4,534,613 A * 8/1985 Esser ..... H01R 13/20 439/834
7,892,050 B2 * 2/2011 Pavlovic ..... H01R 9/245 439/250

(Continued)

FOREIGN PATENT DOCUMENTS

CN 104037523 A 9/2014
DE 102014001692 A1 8/2014

OTHER PUBLICATIONS

European Search Report, dated May 4, 2017, 7 pages.
Abstract of CN104037523, dated Sep. 10, 2014, 2 pages.
Abstract of DE102014001692, dated Aug. 14, 2014, 2 pages.

*Primary Examiner* — James Harvey
*Assistant Examiner* — Oscar C Jimenez
(74) *Attorney, Agent, or Firm* — Barley Snyder

(57) ABSTRACT

A flat contact socket comprises a connection section and a socket body connected to the connection section. The connection section has a continuous connection surface electrically connected to an electrical conductor. The socket body has a plurality of extensions connected to the socket body and a flat contact receptacle into which a flat contact can be inserted. The flat contact receptacle extends along a flat contact plane. The extensions are spaced apart from one another adjacent the socket body and extend away from the socket body to form the continuous connection surface.

20 Claims, 2 Drawing Sheets

(51) Int. Cl.

| | |
|---|---|
| ***H01R 13/18*** | (2006.01) |
| ***H01R 13/22*** | (2006.01) |
| ***H01R 13/24*** | (2006.01) |
| ***H01R 13/35*** | (2006.01) |
| ***H01R 43/16*** | (2006.01) |
| ***H01R 13/187*** | (2006.01) |
| ***H01R 13/627*** | (2006.01) |

(52) U.S. Cl.

CPC ..... *H01R 13/18* (2013.01); *H01R 13/187* (2013.01); *H01R 13/22* (2013.01); *H01R 13/35* (2013.01); *H01R 13/6275* (2013.01); *H01R 4/023* (2013.01); *H01R 4/48* (2013.01); *H01R 13/2442* (2013.01); *H01R 43/16* (2013.01)

(56) References Cited

U.S. PATENT DOCUMENTS

| | | | | |
|---|---|---|---|---|
| 9,722,328 | B2 * | 8/2017 | Wimmer | H01R 4/489 |
| 2007/0066152 | A1 * | 3/2007 | Mohs | H01R 13/113 439/843 |
| 2011/0076901 | A1 * | 3/2011 | Glick | H01R 9/245 439/839 |
| 2012/0129407 | A1 | 5/2012 | Glick et al. | |
| 2014/0087601 | A1 * | 3/2014 | Glick | H01R 13/187 439/834 |
| 2014/0235113 | A1 * | 8/2014 | Glick | H01R 13/114 439/834 |
| 2016/0254610 | A1 * | 9/2016 | Hirakawa | H01R 13/187 439/816 |

* cited by examiner

FLAT CONTACT SOCKET

CROSS-REFERENCE TO RELATED APPLICATIONS

This application claims the benefit of the filing date under 35 U.S.C. § 119(a)-(d) of European Patent Application No. 17151499.5, filed on Jan. 13, 2017, and German Patent Application No. 102016221351.2, filed on Oct. 28, 2016.

FIELD OF THE INVENTION

The present invention relates to a contact socket and, more particularly, to a flat contact socket receiving a flat contact.

BACKGROUND

Flat contact sockets which form an electrical connection between an electrical conductor and a flat contact received in a flat contact receptacle of the flat contact socket are known in the art. Known flat contact sockets, however, unevenly distribute a flow of current from the conductor to the flat contact. The uneven distribution of flow results in areas with a high flow of current and a correspondingly high temperature, which can damage the flat contact socket and the flat contact.

SUMMARY

A flat contact socket according to the invention comprises a connection section and a socket body connected to the connection section. The connection section has a continuous connection surface electrically connected to an electrical conductor. The socket body has a plurality of extensions connected to the socket body and a flat contact receptacle into which a flat contact can be inserted. The flat contact receptacle extends along a flat contact plane. The extensions are spaced apart from one another adjacent the socket body and extend away from the socket body to form the continuous connection surface.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
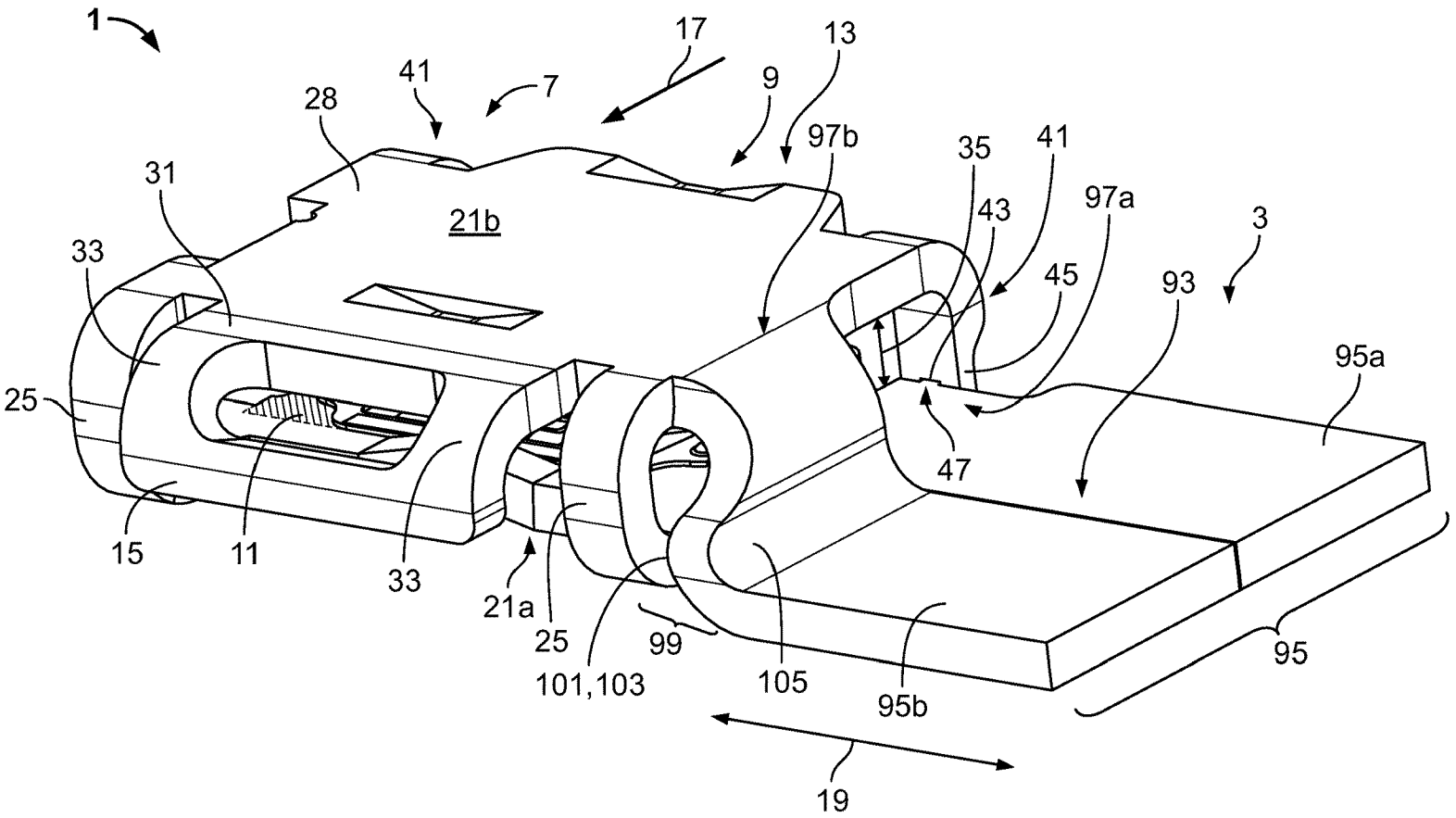
FIG. 1 is a perspective view of a flat contact socket according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
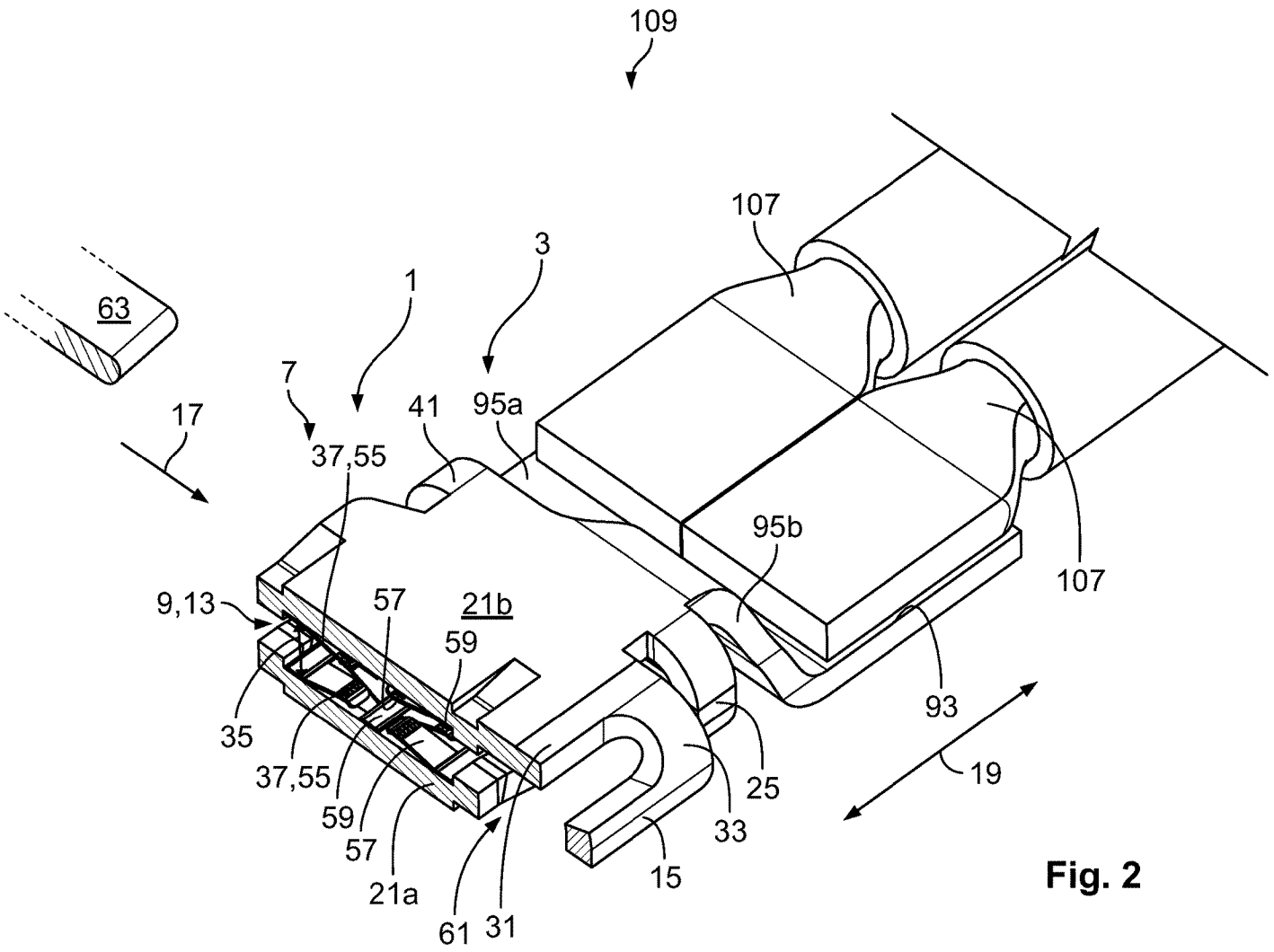
FIG. 2 is a sectional perspective view of the flat contact socket of FIG. 1 with a flat contact and an electrical conductor.

A flat contact socket 1 according to an embodiment is shown in FIGS. 1 and 2. The flat contact socket 1 has a connection section 3 and a socket body 7 connected to the connection section 3. The connection section 3 electrically connects to an electrical conductor 107 and the socket body 7 electrically connects to a flat contact 63. In an embodiment, the flat contact socket 1 is formed from an electrically conductive material 28 by stamping and bending.

The socket body 7, as shown in FIGS. 1 and 2, has a flat contact receptacle 9 extending along a flat contact plane 11. The flat contact receptacle 9 has an insertion opening 13 receiving the flat contact 63. A blocking element 15 is arranged at an end of the socket body 7 opposite the insertion opening 13 and delimits the penetration depth for the flat contact 63 into the flat contact receptacle 9; an insertion direction 17 for the flat contact 63 extends from the insertion opening 13 towards the blocking element 15. The insertion direction 17 extends parallel to the flat contact plane 11. The insertion opening 13 and the blocking element 15 are thus located opposite one another in the insertion direction 17.

The flat contact socket 1 extends along a longitudinal direction 19 running transverse to the insertion direction 17, as shown in FIGS. 1 and 2. The connection section 3 and the socket body 7 are adjacent in the longitudinal direction 19. In the shown embodiment, the connection section 3 is configured such that the electrical conductor 107, in particular a cable, extends substantially parallel to the longitudinal direction 19 after connection to the connection section 3. In other embodiments, the flat contact socket 1 according to the invention may be shaped differently; for example, the connection section 3 may be connected to the socket body 7 in such a way that the connection section 3 extends away from it parallel to the insertion direction 17. In a further alternative, the connection section 3 may extend transverse to the insertion direction 17 and transverse to the longitudinal direction 19.

The socket body 7 has two flat legs 21*a* and 21*b* located opposite one another across the flat contact plane 11, as shown in FIGS. 1 and 2. The legs 21 delimit the flat contact receptacle 9 across the flat contact plane 11. In an embodiment, the legs 21 are formed substantially continuous. Alternatively, the legs 21 may have openings. At an end of the flat contact socket 1 opposite the insertion opening 13, the two legs 21 are interconnected by two webs 25.

The blocking element 15, as shown in FIGS. 1 and 2, is connected to a cantilever 31 which extends away from the rest of the socket body 7 in the insertion direction 17. The blocking element 15 protrudes from the cantilever 31 transverse to the insertion direction 17 and transverse to the longitudinal direction 19; transverse to the flat contact plane 11. As a result, it is possible to receive the flat contact 63 in the flat contact receptacle 9, which projects beyond the rest of the socket body 7 at least in part in the insertion direction 17. The blocking element 15 is spaced apart from the rest of the flat contact receptacle 9 by the above-described arrangement.

In an embodiment, the blocking element 15 is produced in a single piece with the socket body 7 and the rest of the flat contact socket 1; the blocking element 15 and the cantilever 31 may be stamped from the material 28 of the flat contact socket 1. The blocking element 15 can thus transition continuously into the leg 21*b*, and the free end formed by the blocking element 15 can be bent up-wards transverse to the insertion direction 17 and transverse to the longitudinal direction 19.

The blocking element 15 has two braces 33 connecting the blocking element 15 to the cantilever 31 as shown in FIGS. 1 and 2. The blocking element 15 is beam-like in form, and the two braces 33 connecting the blocking element 15 to the cantilever 31 are spaced apart. Material 28 is stamped out or removed between the braces 33 to reduce the required bending forces for producing the shape of the blocking element 15 and for bending the material 28 upwards. In an alternative embodiment, the area between the braces 33 may also be closed.

To delimit the flat contact receptacle 9 effectively in the insertion direction 17 using the blocking element 15, the blocking element 15 extends over half of a height 35 of the flat contact receptacle 9. The height 35 of the flat contact receptacle 9 is measured as a distance between inner faces 37 of the two legs 21 transverse to the flat contact plane 11.

For laterally guiding the flat contact 63 during insertion into the flat contact receptacle 9 and for fixing the position of the legs 21 relative to one another, the flat contact socket 1 has two latching elements 41 shown in FIG. 1. The latching elements 41 are arranged to the side of the flat contact receptacle 9 and are located opposite one another in the longitudinal direction 19, the flat contact receptacle 9 being arranged between them as viewed in the longitudinal direction 19. The latching elements 41 delimit the insertion opening 13 laterally in the longitudinal direction 19.

Each of the latching elements 41 extends from the leg 21*b* to the opposite leg 21*a* and has a positive engagement opening 43 arranged on the free end 45 of the latching element 41. Each latching element 41 is substantially strip-shaped, and may be stamped from material 28 of one of the two legs 21. The latching element 41 is bent towards the opposite leg 21*a* in such a way that the positive engagement opening 43 is arranged at the height of the leg 21*a*. This leg 21*a* has a positive engagement protrusion 47, shown in FIG. 1, which in the connected state is disposed in the positive engagement opening 43, forming a positive engagement transverse to the insertion direction 17. This prevents undesired opening apart and pressing together of the two legs 21 as well as displacement of the two legs 21 in the longitudinal direction 19.

The legs 21 have contacting sections 55, shown in FIG. 2, which electrically contact the flat contact 63 disposed in the flat contact receptacle 9. The contacting sections 55 are arranged on the inner faces 37 of the legs 21. In various embodiments, it is possible for only one of the two legs 21 to have a contacting section 55. Alternatively, one of the legs 21 may also be provided with a pressing device which is formed for mechanically fixing the flat contact 63 in the flat contact receptacle 9.

Each contacting section 55, as shown in FIG. 2, has multiple contact springs 57 which project into the flat contact receptacle 9 and are resiliently deflectable towards the associated leg 21. Each of the inner faces 37 has, in the contacting section 55, a contacting plate 59 which is provided with a plurality of contact springs 57. The contacting plates 59 are electrically connected to the respective legs 21. In an embodiment, the contacting plates 59 are welded to the inner faces 37 of the legs 21. The two contacting plates 59 are located opposite one another across the flat contact receptacle 9. The contacting plates 59 and contacting sections 55 are spaced apart from the blocking element 15 counter to the insertion direction 17. A free space 61, which extends between the contacting sections 55 and the blocking element 15, may receive a touch protector (not shown), which can be arranged around an electrically conductive part of the flat contact 63.

The connection section 3 is welded or soldered to at least one electrical conductor 107, as shown in FIG. 2, at a connection surface 93. The connection surface 93 extends parallel to the flat contact plane 11 and away from the flat contact receptacle 9 and socket body 7 along the longitudinal direction 19. The connection surface 93 is formed by two extensions 95. The extensions 95*a* and 95*b* extend away from the socket body 7 in the longitudinal direction 19, and are positioned adjacent one another transverse to the longitudinal direction 19 and in the insertion direction 17. In various embodiments, the two extensions 95 are flush against one another or have a gap resulting from production between them. The two extensions 95 together form a straight and planar connection surface 93. The two extensions 95*a* and 95*b* extend from two areas 97*a* and 97*b* of the socket body 7 which are spaced apart from one another, as shown in FIG. 1. The area 97*a* is the end of the leg 21*a* located towards the connection section 3 and the area 97*b* is the end of the leg 21*b* located towards the connection section 3. Each of the extensions 95 extends away from one of the legs 21. The extension 95*a* extends continuously from the leg 21*a* parallel to the flat contact plane 11 and forms a continuous and substantially planar surface together with the leg 21*a*.

In another embodiment, the extensions 95*a* and 95*b* both extend initially towards the opposite legs 21*b* and 21*a* and subsequently into the connection section 3. The height of the connection surface 93 can thus, as viewed transverse to the flat contact plane 11, be arranged between the two legs 21*a* and 21*b* located opposite one another; the extensions 95*a* and 95*b* may extend along a plane located centrally between the two legs 21*a* and 21*b*.

In the embodiment shown in FIGS. 1 and 2, proceeding from the leg 21*b*, the extension 95*b* is shaped in such a way that it extends initially towards the leg 21*a* and subsequently along the longitudinal direction 19 away from the socket body 7. As a result, the two extensions 95 can be arranged at the same height in the area of the connection surface 93. The term "height" relates to a direction transverse to the insertion direction 17 and longitudinal direction 19 and parallel to the direction of the height 35 of the flat contact receptacle 9.

Between the connection surface 93 and the leg 21*b*, as shown in FIG. 1, the extension 95*b* has the offset area 99, in which the extension 95*b* is shaped in such a way that proceeding from the leg 21*b* it is arranged at the same height as the extension 95*a*. The offset area 99 is S-shaped as viewed in the insertion direction 17. In other words, from the leg 21*b* the extension 95*b* initially extends away from the leg 21*b* in the longitudinal direction 19 and subsequently runs at least in sections towards the leg 21*a* and the socket body 7. Subsequently, the extension 95*b* runs away from the socket body 7 again in the longitudinal direction 19. As a result, an area 101 is formed which is curved towards the socket body 7 and the convex face 103 of which points towards the socket body 7 and the concave face 105 of which is open towards the connection section 3. As a result of the concave face 105, the connection surface 93 expands in the longitudinal direction 19.

The electrical conductor 107 is welded or soldered to the connection surface 93 in the connection section 3, as shown in FIG. 2, such that a connection to both extensions 95 is established. A flow of current through the flat contact socket 1 can thus be distributed to the two legs 21 via the two extensions 95. In the embodiment shown in FIG. 2, each of the extensions 95*a* and 95*b* may also be welded to at least one electrical conductor 107. The flat contact socket 1 in connection with at least one electrical conductor 107 as shown in FIG. 2 forms a connection assembly 109.

What is claimed is:

1. A flat contact socket, comprising:

a connection section having a planar continuous connection surface electrically connected to an electrical conductor; and a socket body connected to the connection section and having:

a flat contact receptacle into which a flat contact can be inserted, the flat contact receptacle extending along a flat contact plane, at least two legs disposed opposite one another across the flat contact plane, the legs delimiting the flat contact receptacle transverse to the flat contact plane, and a plurality of extensions connected to the socket body, at least one extension extends away from each of the legs, the extensions spaced apart from one another adjacent the socket body and extending away from the socket body to form the planar continuous connection surface.

2. The flat contact socket of claim 1, wherein at least one of the extensions is formed integrally with the socket body.

3. The flat contact socket of claim 1, wherein at least one of the legs has a contacting section electrically contacting the flat contact on an inner leg face of the at least one leg.

4. The flat contact socket of claim 3, wherein the contacting section has at least one contact spring projecting into the flat contact receptacle and deflecting resiliently toward the at least one leg.

5. The flat contact socket of claim 1, wherein the connection surface is welded or soldered to the electrical conductor.

6. The flat contact socket of claim 1, wherein the flat contact socket is stamped and bent from an electrically conductive material.

7. The flat contact socket of claim 1, wherein the socket body has a blocking element disposed at an end of the flat contact receptacle opposite an insertion opening of the flat contact receptacle and delimiting a penetration depth of the flat contact into the flat contact receptacle.

8. The flat contact socket of claim 7, wherein the blocking element extends over half a height of the flat contact receptacle.

9. The flat contact socket of claim 7, further comprising a plurality of latching elements connecting the legs and delimiting the insertion opening in a longitudinal direction of the flat contact socket.

10. The flat contact socket of claim 9, wherein at least one of the legs has a positive engagement protrusion engaging a positive engagement opening disposed on at least one of the latching elements.

11. The flat contact socket of claim 9, wherein the legs are connected by a plurality of webs at a side of the legs opposite the latching elements.

12. The flat contact socket of claim 1, wherein a plane of the planar continuous connection surface is parallel to the flat contact plane and the extensions are positioned adjacent one another in the connection section in an insertion direction in which the flat contact is inserted into the flat contact receptacle.

13. The flat contact socket of claim 1, wherein the extensions are spaced apart from one another adjacent the socket body in a height direction transverse to an insertion direction in which the flat contact is inserted into the flat contact receptacle and transverse to a longitudinal direction of the flat contact socket, and the extensions are disposed at a same height in the height direction in the connection section.

14. The flat contact socket of claim 13, wherein the extensions abut one another in the connection section.

15. The flat contact socket of claim 13, wherein one of the extensions has an offset area extending from one of the legs to the planar continuous connection surface in the height direction and another of the extensions extends from another of the legs parallel to the flat contact plane to the planar continuous connection surface.

16. The flat contact socket of claim 15, wherein the offset area is S-shaped and forms a convex face facing the socket body and a concave face facing the connection section.

17. A connection assembly, comprising:

a flat contact;

a flat contact socket including a connection section having a planar continuous connection surface electrically connected to an electrical conductor; and a socket body connected to the connection section, the socket body having:

a flat contact receptacle into which a flat contact can be inserted, the flat contact receptacle extending along a flat contact plane, at least two legs disposed opposite one another across the flat contact plane, the legs delimiting the flat contact receptacle transverse to the flat contact plane, and a plurality of extensions connected to the socket body, at least one extension extends away from each of the legs, the extensions spaced apart from one another adjacent the socket body and extending away from the socket body to form the planar continuous connection surface; and the electrical conductor conductively connected to the connection surface.

18. The connection assembly of claim 17, wherein the electrical conductor is welded or soldered to the connection surface.

19. The connection assembly of claim 17, wherein a plurality of electrical conductors are electrically connected to the connection surface.

20. The connection assembly of claim 19, wherein each of the electrical conductors is electrically connected to one extension.

* * * * *